United States Patent [19]

Brandstrom

[11] 4,064,731

[45] Dec. 27, 1977

[54] DEVICE FOR INSERTING A HOT, HEAVY BLANK IN A DIE

[75] Inventor: Karl Ivar Brandstrom, Karlskoga, Sweden

[73] Assignee: AB Bofors, Bofors, Sweden

[21] Appl. No.: 635,570

[22] Filed: Nov. 26, 1975

[30] Foreign Application Priority Data

Dec. 11, 1974 Sweden ..... 7415512

[51] Int. Cl.[2] ..... B21D 43/16; B65G 13/00

[52] U.S. Cl. ..... 72/419; 198/631; 214/26

[58] Field of Search ..... 72/419, 420, 422, 251, 72/210; 83/109, 156, 157, 404; 198/127 R, 218, 574, 631; 214/26

[56] References Cited

U.S. PATENT DOCUMENTS

| | | | |
|---|---|---|---|
| 1,596,881 | 8/1926 | Lacke | 72/422 |
| 2,159,779 | 5/1939 | Cavin | 72/419 X |
| 2,504,228 | 4/1950 | Sandberg et al. | 83/404 X |
| 2,929,280 | 3/1960 | Judge et al. | 72/419 |
| 2,933,966 | 4/1960 | Dehn | 83/157 X |
| 2,965,209 | 12/1960 | Maki | 72/419 X |
| 2,970,682 | 2/1961 | Fisk | 198/218 X |
| 3,061,075 | 10/1962 | Wise | 198/631 X |
| 3,141,367 | 7/1964 | Keener et al. | 83/282 X |
| 3,149,734 | 9/1964 | Ilmoni | 198/574 X |
| 3,336,787 | 8/1967 | Hutson et al. | 72/420 |
| 3,344,902 | 10/1967 | Crawford | 198/631 X |
| 3,451,247 | 6/1969 | Miltenberger | 72/419 X |
| 3,596,548 | 8/1971 | Chiba | 83/404 X |
| 3,848,725 | 11/1974 | Toby | 198/127 R X |
| 3,916,742 | 11/1975 | Biernot | 83/157 X |
| 3,929,219 | 12/1975 | Malcolm | 198/574 X |

*Primary Examiner*—C.W. Lanham
*Assistant Examiner*—D. M. Gurley
*Attorney, Agent, or Firm*—Pollock, Vande Sande & Priddy

[57] ABSTRACT

A device for inserting a hot, heavy blank into a drop hammer die comprises a car mounted on rails for movement toward and away from the die and supporting a unit thereon adapted to be positioned in at least partially overlying relation to the die. The unit includes a pair of elongated rotatable shafts positioned in spaced parallel relation to one another with each shaft supporting a plurality of elongated rollers extending from that shaft partially across the space between the shafts. Positioning means are provided for selectively rotating the elongated shafts to vary the planar relationships of the rollers relative to one another, and further positioning means are provided for varying the orientation of the plane defined by the shafts between horizontal and inclined positions.

14 Claims, 14 Drawing Figures

DEVICE FOR INSERTING A HOT, HEAVY BLANK IN A DIE

The present invention relates to a device for inserting a hot, heavy blank in a die, primarily a die for a drop hammer.

Due to the fact that the very hot (approximately 1200° C) blank particularly for large drop hammers, is very heavy, there is a pronounced need for an insertion procedure which is to a high degree automatized, which provides for such a distinct application of the blank in the die that at least no major subsequent adjustments need be made by the personnel at the drop hammer. The weight and the high temperature of the blank involve special requirements for the device in question, which moreover should be built up of uncomplicated and sturdy components, and permit rapid feeding of the blank.

The present invention relates to a device which solves the problems envisaged above. The features that can mainly be considered to be characteristic for a device according to the invention are that it comprises a unit which can be moved in at least partly over the die, and which is made with side parts between which are applied slide members, particularly in the form of rollers, which form two roller conveyor parts, that in order to provide for a dropping moment for the blank from the slide member to the die, the respective slide members are fastened only at one of their ends in either side part and arranged so that they can be turned down, in or with the side part in question, and that slide members for guiding in the blank are also arranged in the side parts so that they together form a substantially V-formed cradle in a stage preceding the dropping moment.

Figure 1:
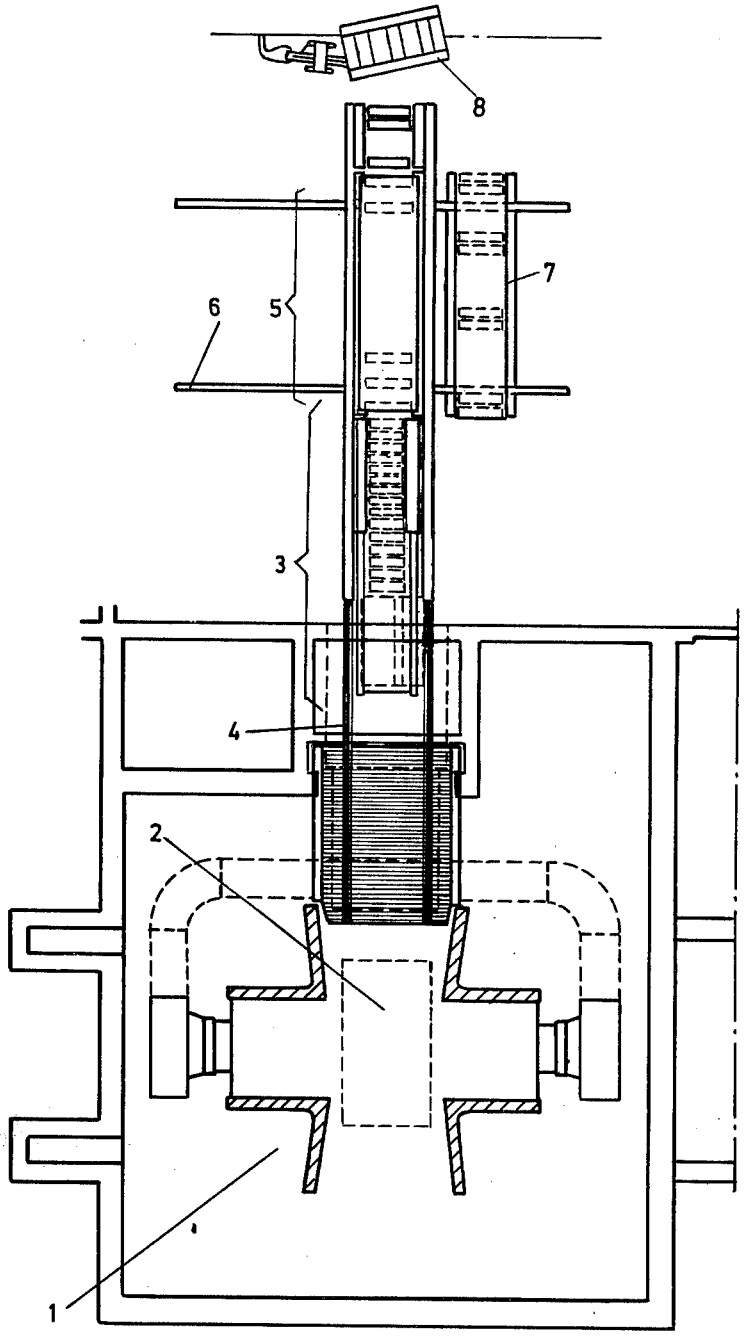
Figure 5:
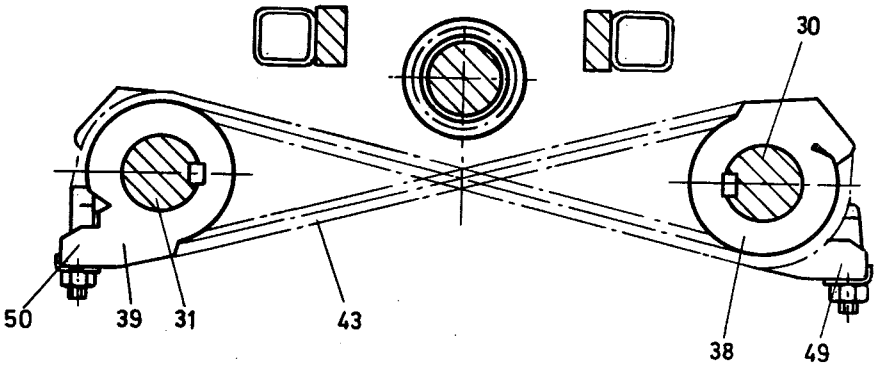
Figure 6:
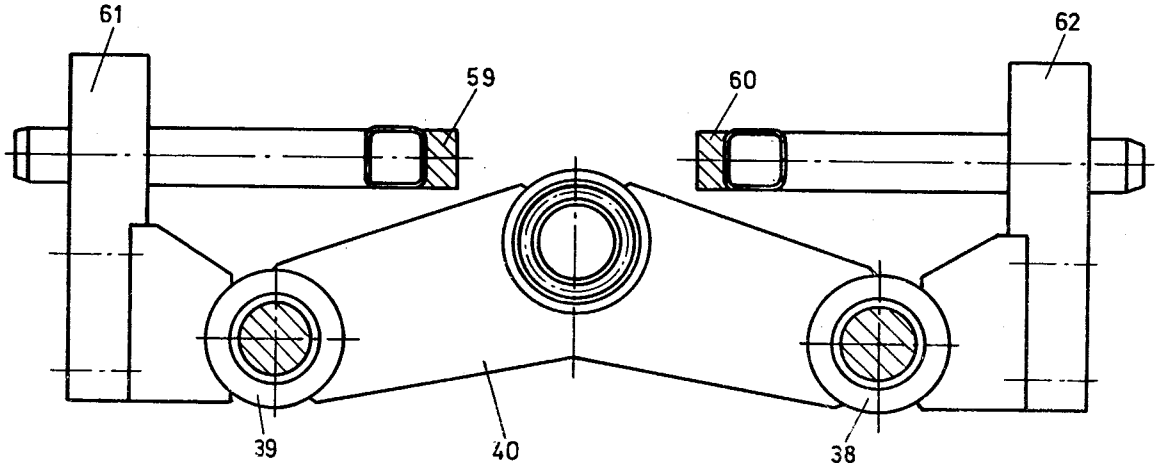

An embodiment proposed at present of a device which has the characteristics significant for the invention will be described in the following, with reference to the accompanying drawings, in which FIG. 1 is a view in a horizontal plane depicting the device of the present invention together with other transport members at a drop hammer, FIG. 2 constituting FIGS. 2*a* and 2*b* considered together, is a view in a vertical plane depicting the device, FIG. 3 constituting FIG. 3*a* and 3*b* considered together, is a view in a horizontal plane and partly in cross section showing the device along a section A—A in FIG. 2, FIG. 4 in a vertical plane view and in cross section shows the device along a section B—B in FIG. 2, FIG. 5 in a vertical plane view and in cross section shows the device along a section C—C in FIG. 2, FIG. 6 in a vertical plane view and in cross section shows the device along a section D—D in FIG. 2, FIG. 7 in a vertical plane view and in cross section shows the device along the section E—E in FIG. 2, FIG. 8 in a vertical plane view and in cross section shows the device along the section F—F in FIG. 2, FIG. 9 in a side view shows parts of the device according to FIG. 2 in a horizontal position, and FIG. 10 in a side view shows parts of FIG. 9 in an inclined position.

In FIG. 1, the numeral 1 designates a so-called duplex hammer, in which a die 2 is assumed to be applied. A device 3 for automatic insertion of hot blanks is arranged behind the hammer. In the example of the embodiment, the device 3 consists of a rail-bound car, which can be run on rails 4 between a fetching position according to FIG. 1 and a depositing position at the hammer. Each rail 4 consists of the inside of a U-formed beam standing on edge, (see FIG. 8) of an open groove in the floor in question. In the fetching position, the car 3 has its rear section moved up against a fixed roller conveyor part 5 included in the transportation chain for the blank. In principle, said roller conveyor parts is comprised in a station for removing scale. Further, the part of the transportation chain consists of, in principle, a car that can be run at right angles to the longitudinal direction of the part of the transport chain which car supports the roller conveyor 5 for the blank and which can be run on rails 6 which extend at right angles to the rails 4. Said station for removing scale comprises two spreading rings, not shown, for water, which is sprayed over the blank when this passes the station. The spreading rings are then placed in such a way that the blank can pass through them, at the same time as they are made so that at the passage of the blank this will be sprayed with two conical films of water, with high pressure, the points of the respective cones of water from the spreading rings then being directed against or coinciding with each other. The car which has the lateral movement and which is comprised in the transport chain, together with the spreading rings belonging to the car, also comprises a corresponding roller conveyor part 7. Said roller coveyors 5 and 7 can be switched in relation to each other through the movement of the car running laterally. There is also a turntable 8 connected to the roller conveyor part 5, on which a blank in a first turning position can be deposited from a heating furnace not shown. In the other position of the turntable 8 according to FIG. 1, the blank can be transferred to the roller conveyor part 5. The turntable 8, like the roller conveyor part 5, is made with driven rollers, which are driven by means of a chain drive, not shown in detail, which can be made in a way which is known in itself.

Figure 2:
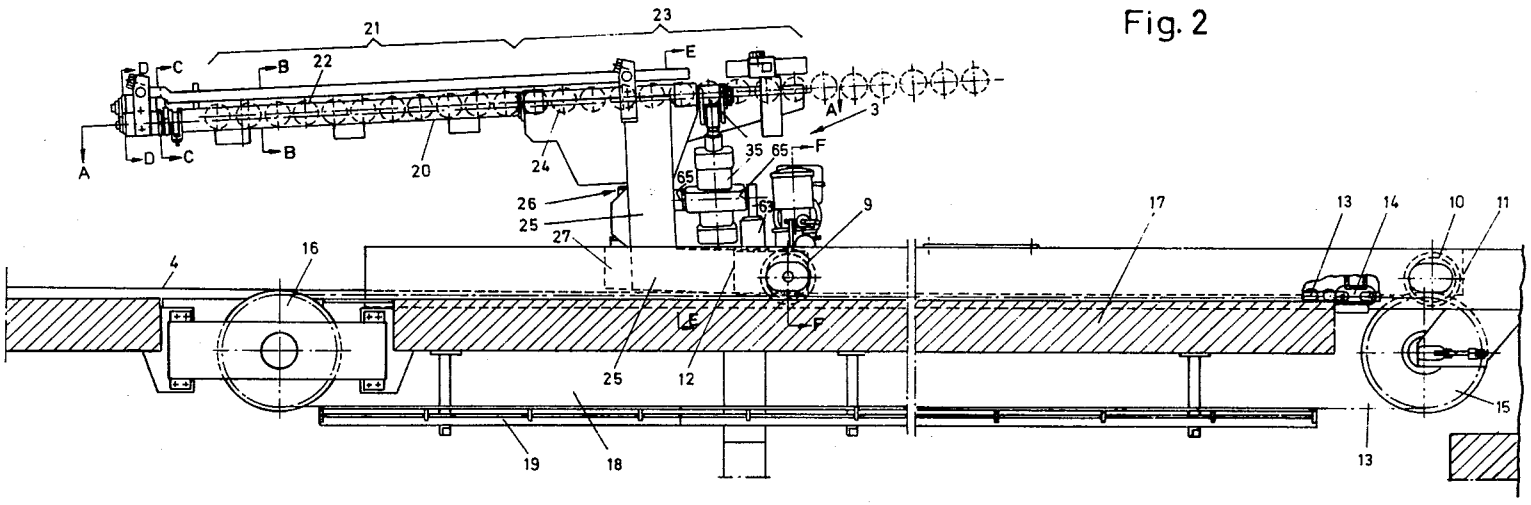
Figure 2A:
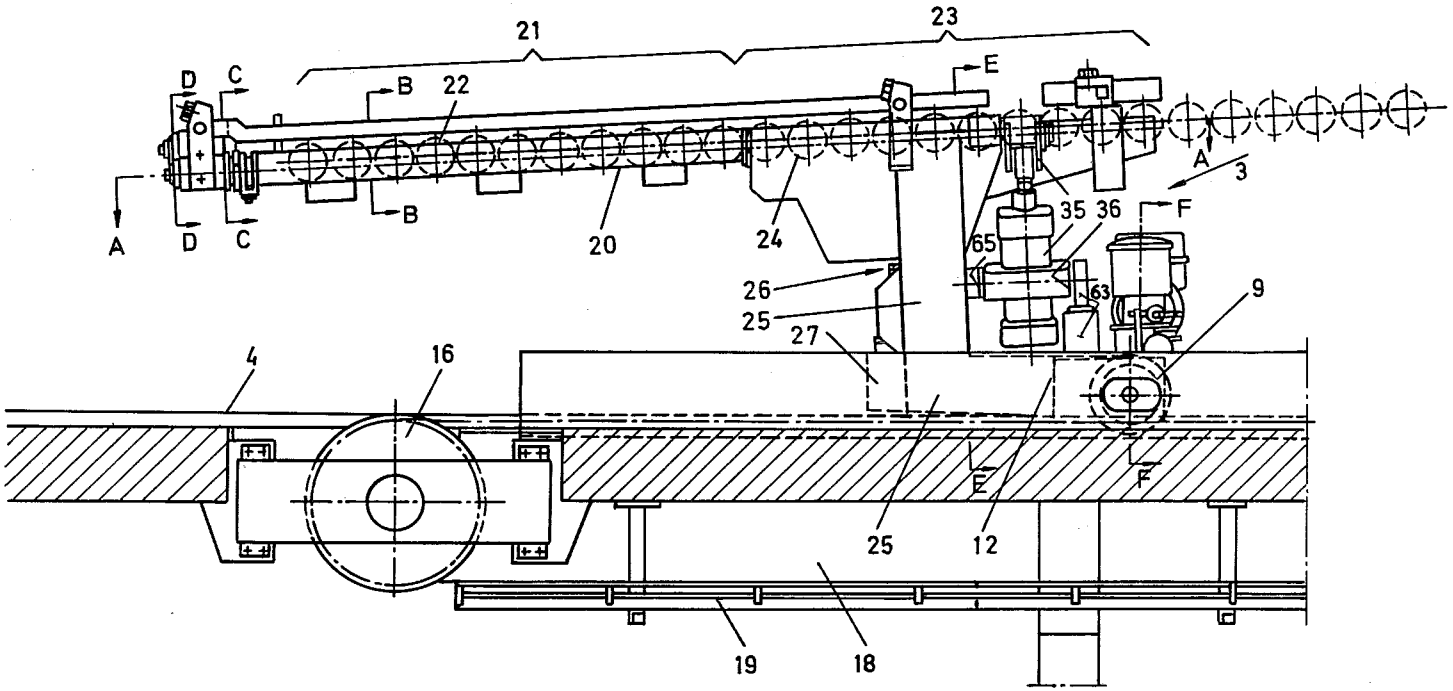
Figure 2B:
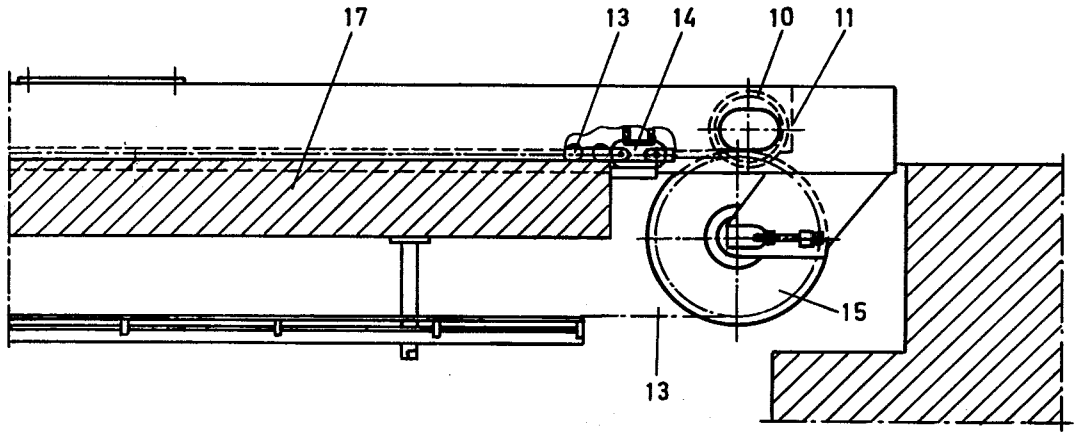

FIG. 2 is intended to show the car 3 and its driving machinery in more detail. The car has two pairs of wheels, and the front pair is represented by the wheel 9 and the rear pair by the wheel 10. In principle, the car comprises a rectangular bottom frame, the rear part of which is designated 11 and the front part 12 in FIG. 2. The wheels of the car run in the rails 4 which in the part shown in FIG. 2 are included in said U-beam standing on edge. The car can be driven by a chain 13 which is fastened to the car in a fastening device 14. The chain drive includes two sprockets 15 and 16, the latter of which can be driven by means of a motor not shown in detail, of e.g. the hydraulic type. The rails 4 are assumed to be mounted on a floor, and therefore the sprockets 15 and 16 are placed in recesses in the floor.

In the figure, a concrete slab supporting the rails 4 is designated 17. Under the slab a trough 18 is arranged, in which a slide rail 19 for the chain is placed. The distance between the sprockets 15 and 16 is approximately 6 meters, and the length travelled by the car 3 is approximately 5.3 meters. During the travelling movement towards the drop hammer, the front pair of wheels 9 will leave the U-beam and continue on the rails 4, which are then laid directly on the floor, up to the drop hammer (see FIG. 1). At the maximum travelling movement, the rear pair of wheels 10 does not leave the U-formed beam, and this can prevent tipping tendencies around the axle for the front pair of wheels when the car supports the heavy blank in front of its front parts.

At its front end, said car 3 supports a unit 20 which can be inserted partly over the die 2 shown in FIG. 1. The unit 20 comprises a front slide conveyor or roller conveyor part 21 with sliding members in the form of rollers 22 and a second slide conveyor or roller conveyor part 23 with sliding members in the form of rollers 24. When the car 3 is in its fetching position, the rear part of the roller conveyor part 23 is located at the front part of the roller conveyor part 5 shown in FIG. 1. A blank transferred from the roller conveyor part will thus be transferred to the roller conveyor part 21 via the roller conveyor part 23.

Figure 7:
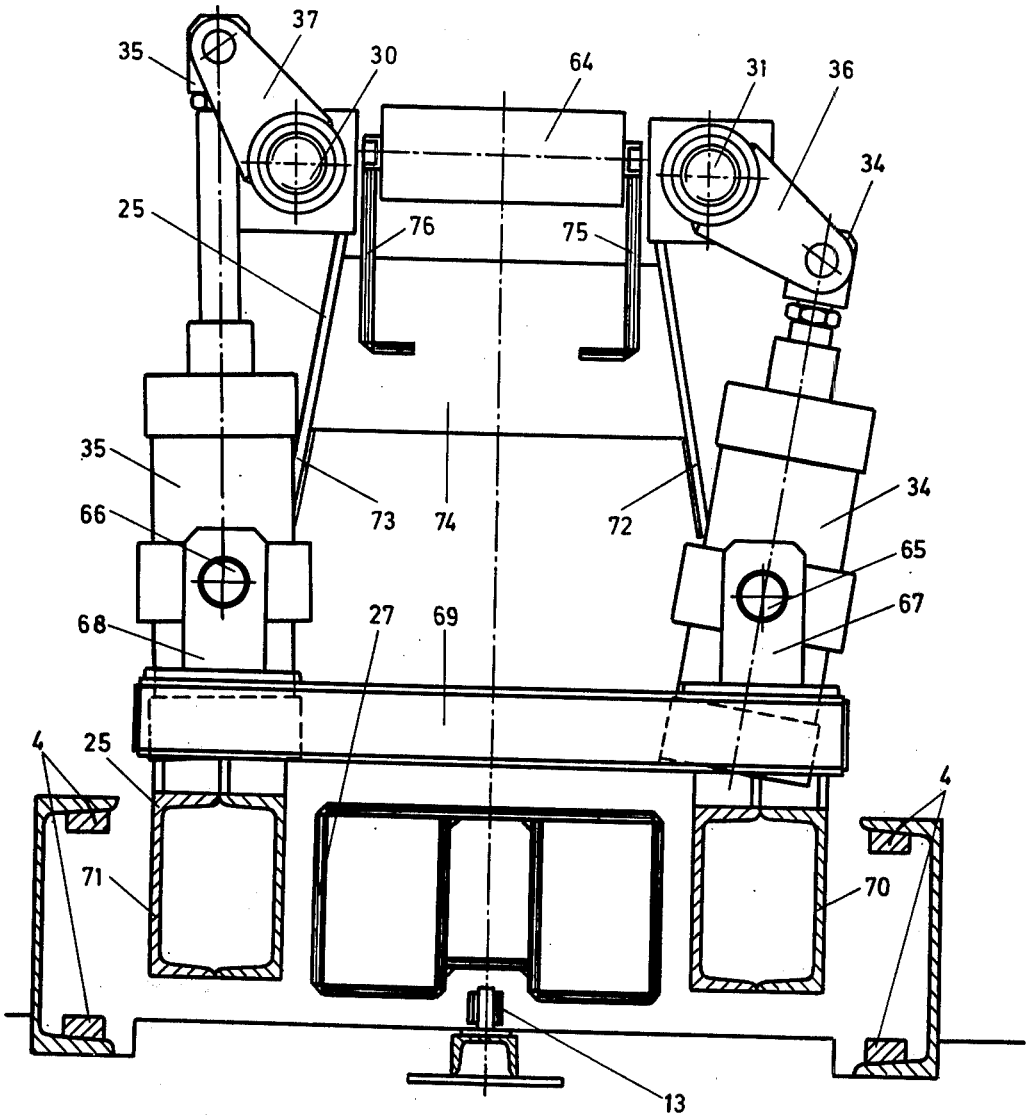

The unit 20 which can partly or entirely be inserted over the die 2 is firmly supported in the upper end of an angular part 25, one leg of which, supporting said upper end, is substantially vertically arranged, and the second leg of which is substantially horizontally arranged (see FIG. 7). The second end, which is located on said second leg, is supported on the axle of the front pair of wheels 9. Said support is made rotatable by means of a first hydraulic cylinder, the position of which is indicated with the numeral 26 in FIG. 2, and which is firmly arranged in a protruding part 27 of the car 3. The piston of the cylinder coacts with a supporting pin in the unit, as described in the following. Through the suspension arrangement shown, the unit will be arranged so that is can be tipped between an inclined position according to FIG. 2 and a horizontal position.

Figure 3:
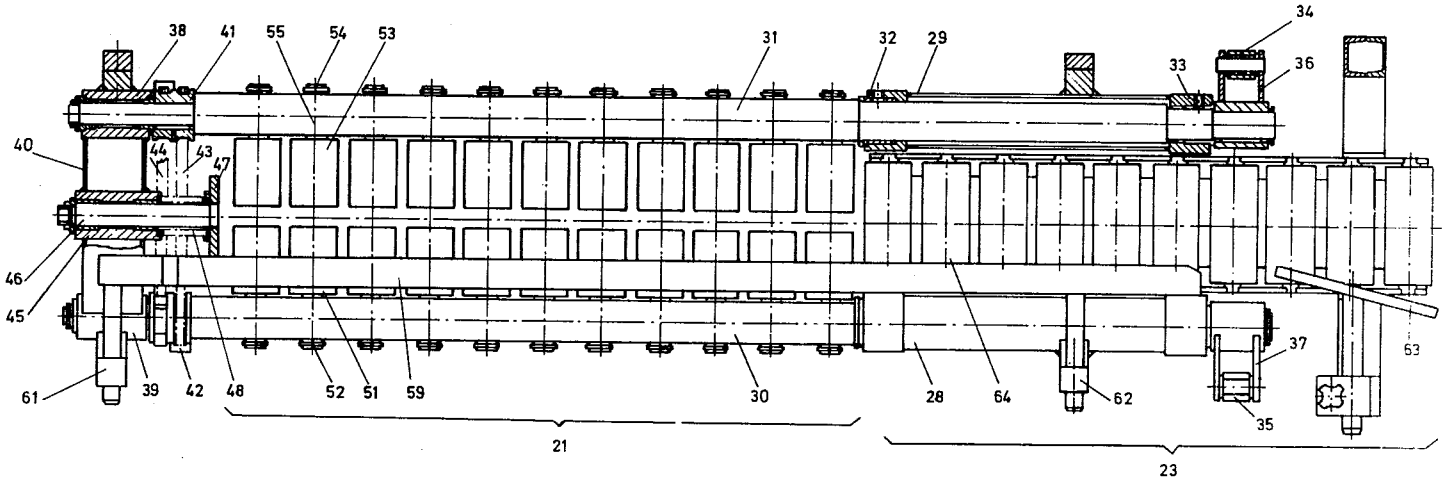
Figure 3A:
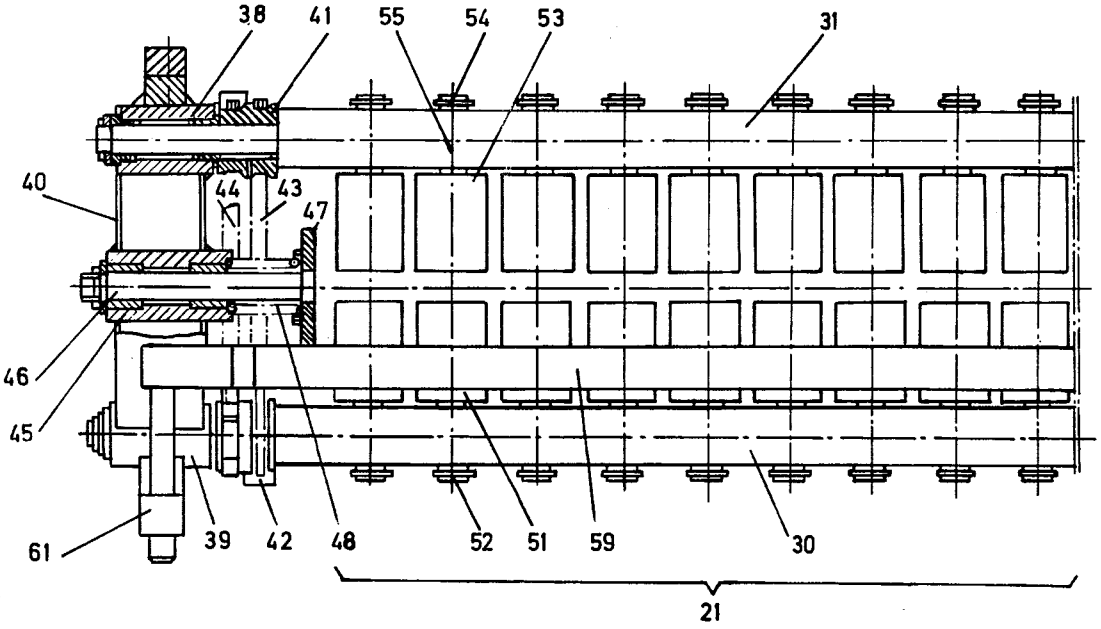
Figure 3B:
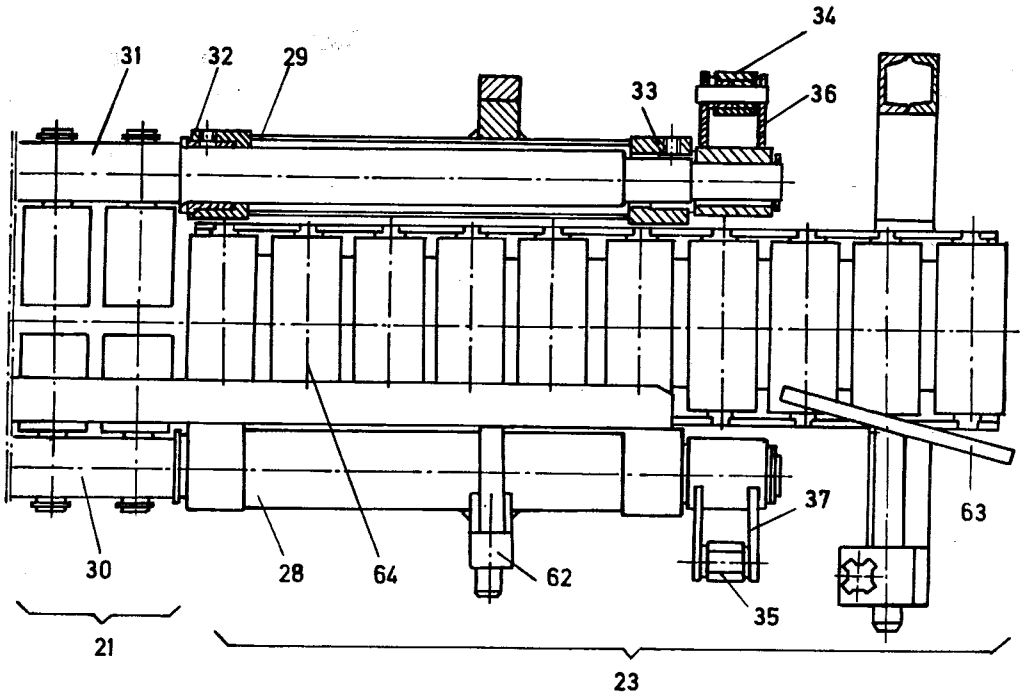

FIG. 3 shows, in more detail, the design of the unit, which in addition to the roller conveyor parts 21 and 23 comprises side parts to which the slide members are fastened. At the rear section of the unit, the side parts comprise supporting members 28 and 29 for shafts 30 and 31, which extend along the major portion of the longitudinal extent of the unit. The shafts 30, 31, are rotatably arranged around their longitudinal center lines in two bearings 32 and 33 respectively, at said supporting members 28 and 29 on the rear parts of the unit. Farthest to the rear, the shafts are connected to control members in the form of two hydraulic cylinders 34 and 35 (see also FIG. 2) each of which, via a lever 36, 37, is fastened to the ends of the axles. The shafts 30 and 31 are also supported at their front ends via supporting members 38, 39, respectively, which as shown in FIG. 6 are connected together by means of a spacing member 40, At the front ends of the shafts wheels 41 and 42 for chains 43 and 44 are also firmly fastened via keys, by means of which a movement from one shaft is transferred to the other shaft and vice versa. The movement of the hydraulic cylinders will thereby be coordinated. At its central part, said spacing member 40 has a support 45 for a shaft 46 which can be displaced in its longitudinal direction in the support 45, and which has one end fastened to a stopping plate 47 for the blank. Between the stopping plate 47 and the housing for the support 45, a spring 48 is set, which absorbs the impact forces against the stopping plate caused by the blank. As shown in FIG. 5, the supports 38, 39 are provided with setting members 49 and 50.

As will be noted from FIG. 3, one of the elongate shafts 30 supports first slide members or rollers 51, which respectively are supported in one end on a journal 52. In a corresponding way, the second shaft 31 supports second slide members or rollers 53, which respectively are supported on a journal 54 in the shaft 31. The first and second rollers, respectively, have been given a length which is somewhat less than one half of the distance between the shafts 30 and 31. The first and second rollers are set opposite each other, and the respective pairs of the first and second rollers have a common axis of rotation 55.

Figure 4:
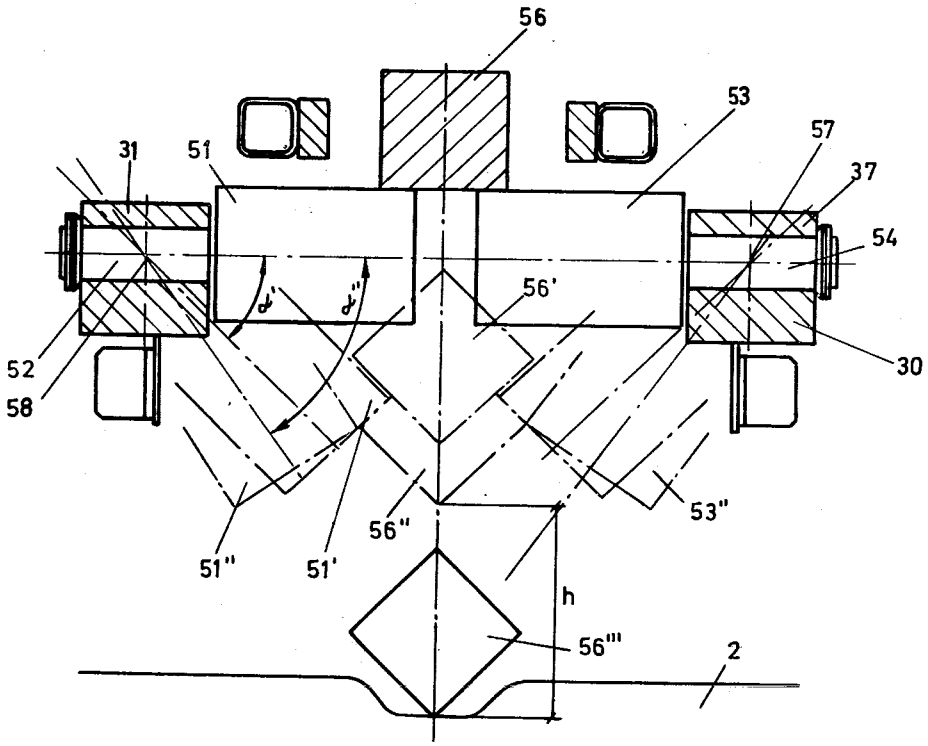

FIG. 4 shows a blank 56 with a substantially square cross section located on the first roller conveyor part 21. The first and second rollers 51 and 53, which through the arrangement shown will be arranged so that they can be turned down with the shafts 30 and 31, in a position where the blank is in contact with the stopping plate 47, assumes the horizontal position indicated with solid lines. By turning the shafts 30 and 31 around their center lines 57 and 58, the first and second rollers are turned downwards. In a turned down position shown by the angle $\alpha'$ the first and second rollers have assumed a position where they form a substantially V-formed cradle for the blank, which has turned 45° in the cross section, and assumes the position shown by 56'. When the rollers are turned down further, a turning angle $\alpha''$ is reached, where the distance between the parts located opposite each other of the opposite rollers exceed the diagonal of the blank with the square cross section, which then assumes the position shown by 56''. In this situation, the actual dropping moment of the blank from the rollers to the die 2 commences. The dropping height during the dropping moment is designated $h$.

Through the turning down shown of the rollers, simple guiding of the blank laterally before the actual dropping moment is obtained. Tests have shown that the blank falls down into the die and assumes a distinct position, in which the forging in the drop hammer usually can commence without any subsequent adjustments.

The unit according to FIG. 3 is also provided with further guiding members in the form of guide strips 59 and 60 (see FIG. 6) for guiding the blank. The strips are fastened at their ends to adjusting devices 61 and 62, by means of which the strips can be adjusted in the lateral direction of the unit. At its rear part, the unit has further guide strips 63, on both sides. Contrary to the case of the first and second rollers 51, 53, the rollers 64 in the rear part 28 of the roller conveyor have both ends supported in the side parts. The number of rollers in each part of the roller conveyor can be chosen in dependence on the length of the unit. In the example of the embodiment, the number of rollers chosen for the first rollers, as well as for the second rollers, in the first part 21 of the roller conveyor, is 11, while in the rear part 23, of the roller conveyor, 10 rollers have been chosen.

FIG. 7 shows the designs of the fastening members for the second hydraulic cylinders, and strictly for the purpose of illustration, the cylinder 34 has been shown with its piston in an unactuated position, where the second rollers have the horizontal position, while the cylinder 35 is shown with its piston in an actuated position, and the first rollers are thus in their fully turned down position. The cylinders 34 and 35 are rotatably supported on supporting journals 65 and 66, respectively, which in turn are supported on supports 67 and 68, respectively, arranged on a cross beam 69 on the angular part 25. Through the support shown for the cylinders 34 and 35, these can carry out the rotating movements necessary around the supporting journals when they actuate the shafts 30 and 31. The lower, substantially horizontal leg of said angular part 25 is formed of two frame parts 70 and 71 which are parallel to each other, and both of which are supported on the axle for the front pair of wheels. The substantially vertically arranged leg of the angular part comprises side parts 72 and 73 connected to the frame parts 70 and 71, respectively, which side parts are inclined inwards, counted from below, and which at their upper ends are held together by a cross part 74, and hold the supporting members for the shafts 30 and 31. FIG. 7 also shows vertical supporting plates 75 and 76 for the rollers 64.

Figure 8:
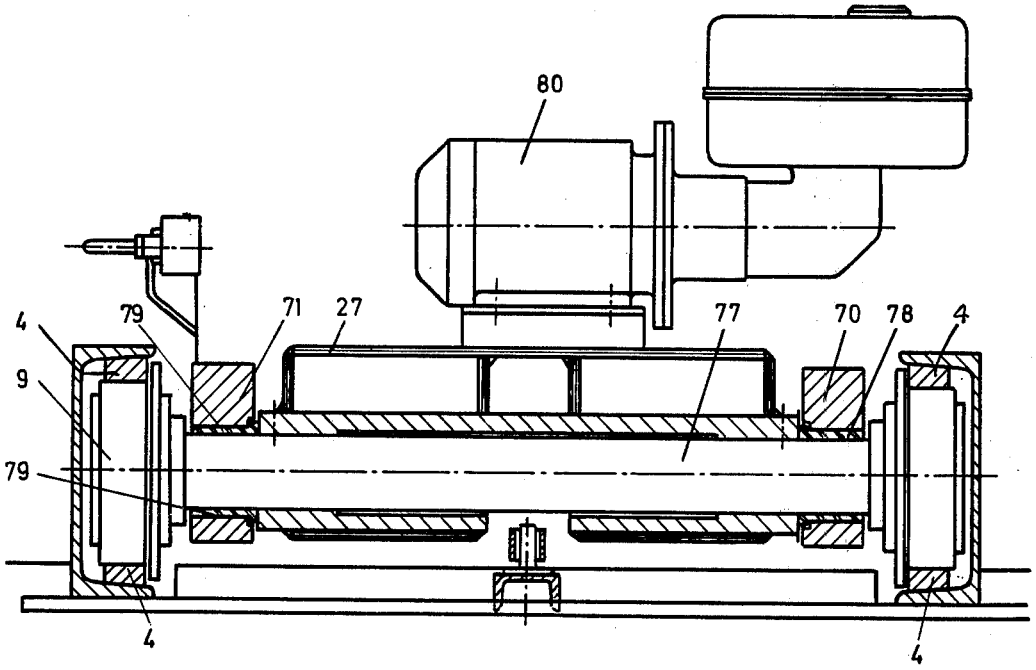

FIG 8 shows the design of the wheels of the car and the way in which they are placed in the U-formed rails 4. The design of the frame parts 70 and 71 is also shown, at the axle 77 of the front pair of wheels 9, where said frame parts are supported via bearing bushings 78 and 79, so that the frame part can easily be tipped around the axle 77. The device also supports a hydraulic unit 80, for the power supply to said hydraulic cylinders.

Figure 9:
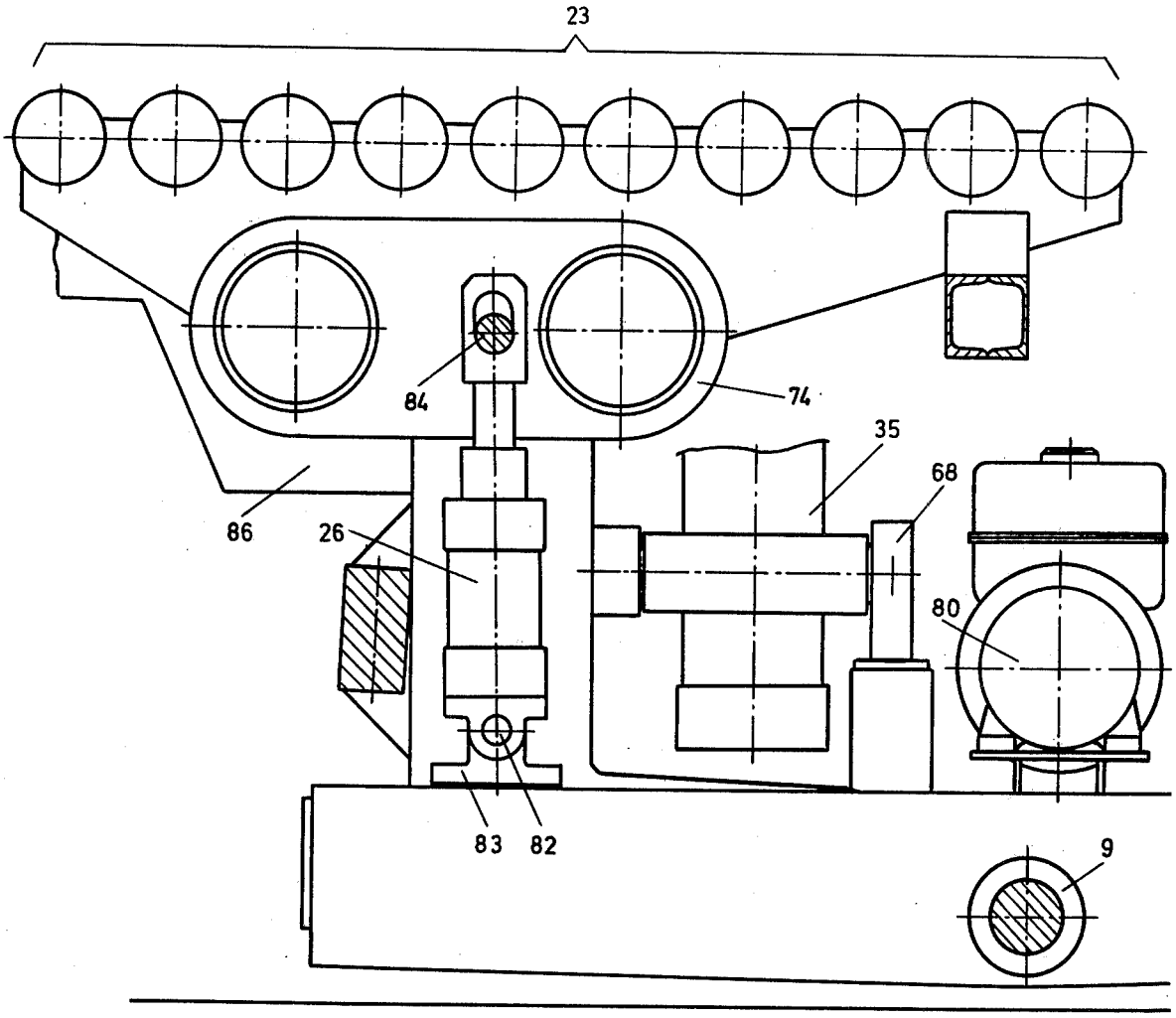
Figure 10:
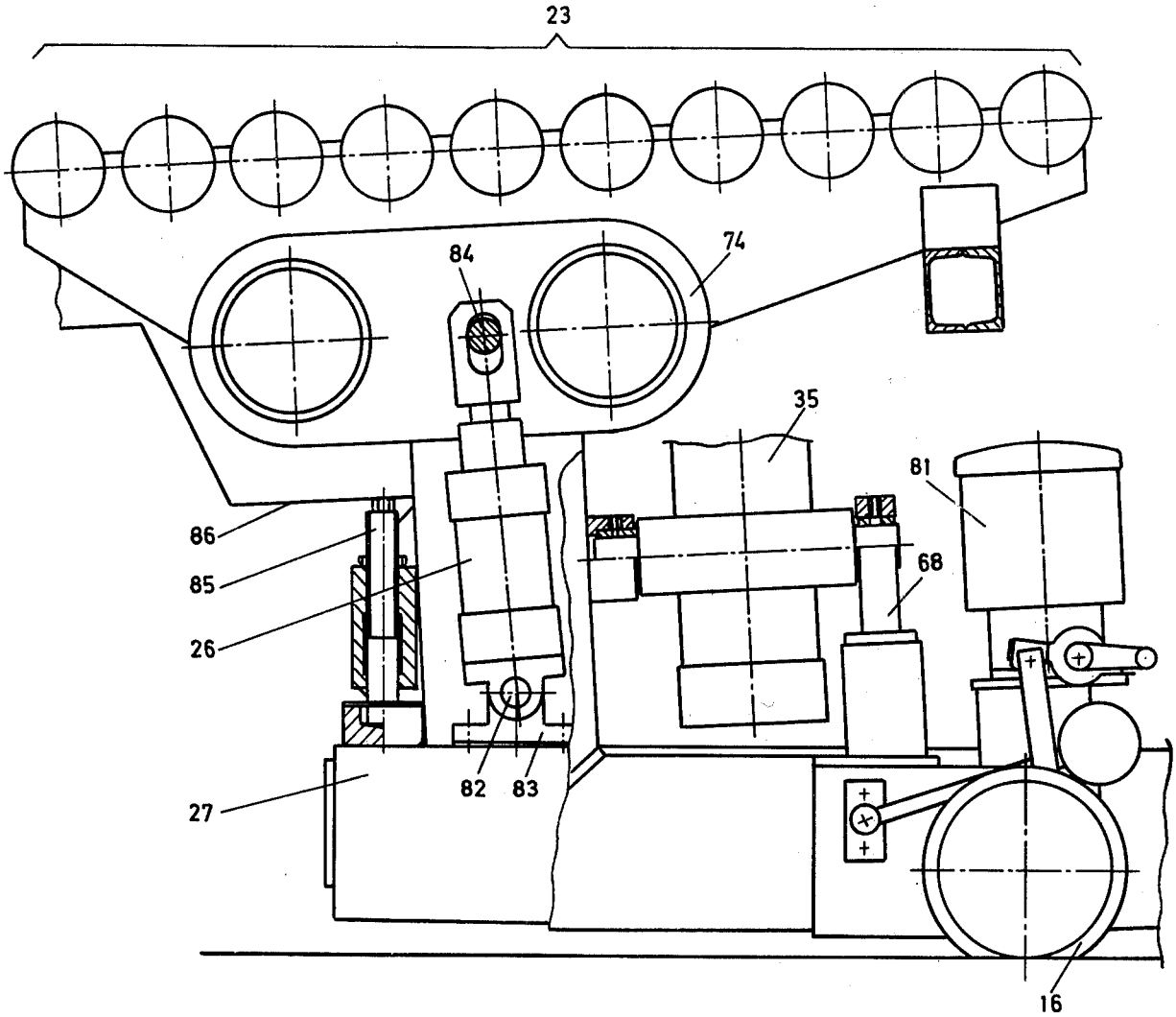

In accordance with the above, the tipping movement of the unit 20 and the angular part 25 around the axle 77 is achieved by means of the hydraulic cylinder 26, which is shown particularly in FIGS. 9 and 10. The cylinder 26 is rotatably supported on a journal 82 which, in turn, is supported in a bearing bracket 83 in the frame of the car. The piston of the cylinder is fastened in the cross part 74, which is made with a bearing pin 84 for this purpose. The unit coacts with a setting device 85, which is fastened in the frame 27 of the car, and presses against an under surface 86, with which the inclined lower position of the unit can be set at the position desired according to FIG. 10. When the unit is to be given an inclination according to FIG. 10, where the blank of its own weight can slide down towards the front part of the roller conveyor, the single-action hydraulic cylinder 26 is actuated so that it will successively be without pressure, and the unit then sinks down towards the setting device 85.

When the control valve belonging to the hydraulic cylinder is switched over, the cylinder receives pressure again, and the unit then returns to the horizontal position.

The functions of the other parts of the car, not shown in detail, and the other equipment belonging to it, should be obvious from the context.

The function of the equipment described above will then be as follows. When the hot blank has been removed from the furnace and placed on the turntable 8, it is transferred to the part 5 of the roller conveyor, where the scale is removed. In accordance with the above, the rollers in the parts 5 and 8 are driven mechanically. The blank is thereafter transferred by said driven rollers over on to the rear parts of the unit 20, where it is guided along parts 23, 21 by the side strips 59, 60. In connection therewith, the unit 20 is given an inclination as in FIGS. 2 and 10, which causes the blank to be moved of its own weight towards the free end of the unit, where the stopping plate 47, with its spring action, limits the movement of the blank. The car 3 with the unit 20 is then run in along rails 4, and at the end of the running movement, the unit 20 will extend in over the die 2 with its parts which support the blank. After the leveling of the unit 20, which takes place during running movements to the position according to FIG. 9, the shafts 30 and 31 are then turned, and the blank is then guided and dropped into the die. The guiding of the blank in the longitudinal direction of the die is determined by the running movement of the car, and therefore, at the insertion, the car is to be given a predetermined position or stop at the drop hammer. After dropping the blank in the die, the car returns to fetch a new blank, and so on.

The control devices for the hydraulic cylinders and the chain transmission for the car can be made in ways which are known in themselves, and with components which are known in themselves.

The invention is not limited to the embodiment shown above as an example, but can be subject to modifications within the scope of the following claims.

I claim:

1. A device for inserting a hot, heavy blank into a die in a drop hammer or the like, comprising a car mounted for movement toward and away from the die, an upstanding supporting member on said car extending upwardly from said car in a direction transverse to the direction of movement of said car, an elongated unit mounted on said supporting member above said car for movement with said car, said elongated unit extending in a direction parallel to the direction of movement of said car and having a portion which projects as a cantilever from said supporting member forwardly of the front end of said car whereby movement of said car toward the die is adapted to move the forwardly projecting portion of said elongated unit into at least partially overlying relation to the die, said elongated unit including a pair of elongated shafts mounted for rotation about their respective axes of elongation, said shafts being disposed in spaced relation to one another and extending in the direction of movement of said car, a first plurality of elongated coplanar slide elements attached at one end to one of said rotatable shafts and extending in spaced relation to one another in directions transverse to the direction of elongation of said one shaft partially across the space between said shafts toward the other of said shafts, a second plurality of elongated coplanar slide elements attached at one end to said other rotatable shaft and extending in spaced relation to one another in directions transverse to the direction of elongation of said other shaft partially across the space between said shafts toward said one shaft, the free end of each of said first plurality of slide elements being disposed adjacent to and spaced from the free end of one of said second plurality of slide elements in the space between said shafts, said blank being adapted to be supported on said slide elements adjacent their respective free ends, spacer means extending between the forward ends of said shafts relative to said die for preventing said forward ends of said shafts from spreading apart from one another due to the weight of said blank, and positioning means on said car coupled to said elongated unit for rotating each of said elongated shafts through selected angles to vary the orientation of said coplanar pluralities of slide elements, transmission means interconnecting said shafts adjacent said forward ends of said shafts for causing the rotation of one shaft through a given angle in a given direction to effect synchronized rotation of the other shaft through said given angle in the opposite direction, said positioning means cooperating with said transmission means to selectively effect a first relative position of the slide elements in the forwardly projecting portion of said elongated unit wherein said first and second pluralities of slide elements in said forwardly projecting portion are disposed in substantially coplanar relation to one another, being operative to selectively effect a second relative position of the slide elements in said forwardly projecting portion of said elongated unit wherein said first plurality of coplanar slide elements are disposed in a plane inclined downwardly from said one shaft and said second plurality of coplanar slide elements are disposed in a plane oppositely inclined downwardly from said other shaft with the free ends of said first and second pluralities of slide elements being spaced from one another between said shafts by a distance less than the width of said blank to define a substantially V-shaped cradle for supporting the blank on said forwardly projecting portion at a position overlying the die forwardly of said car and below the plane defined by said pair of shafts, and being operative to effect a third relative position of the slide elements in said forwardly projecting portion similar to said second relative position of said slide elements but wherein the planes of said pluralities of slide elements in said forwardly projecting portion of said elongated unit are further inclined to space the free ends of said first and second slide elements from one another between said pair of shafts by a distance greater than the width of said blank to drop the blank from said V-shaped cradle into the die.

2. The structure of claim 1 wherein each of said slide elements comprises a roller journaled for free rotation in its respective shaft.

3. The structure of claim 1 including further positioning means operative to vary the positioning of said shafts between a horizontal position operative to support said blank in fixed position on said slide elements, and a tilted position operative to cause said blank to slide of its own weight along said slide elements and between said tilted shafts toward the forwardmost end of said unit.

4. The structure of claim 3 wherein said further positioning means is coupled to said upstanding supporting member, the upper end of said supporting member being attached to said unit, and the lower end of said supporting member being mounted for pivotal movement about an axis which is parallel to the plane defined by said shafts and which is oriented at right angles to the directions of elongation of said shafts.

5. The structure of claim 4 wherein said device comprises a plurality of rails defining the path of movement of said device, said car being mounted for movement along said rails thereby to effect simultaneous movement of said unit along said rails.

6. The structure of claim 5 wherein said further positioning means comprises a hydraulic cylinder carried by said car.

7. The structure of claim 5 wherein said car includes a pair of front wheels and a pair of rear wheels, the axis about which said supporting member is mounted for pivotal movement being coincident with the axis of rotation of said front wheels.

8. The structure of claim 3 wherein said positioning means comprises a hydraulic cylinder, said further positioning means comprising a further hydraulic cylinder.

9. The structure of claim 3 wherein said spacer means comprises a unitary spacing member extending between said shafts adjacent the forward ends of said shafts relative to the die, and resilient abutment means supported by said unitary spacing member and extending rearward of the forward ends of said shafts at a location substantially mid-way between said shafts for limiting said sliding movement of a blank toward the forwardmost end of said unit.

10. The structure of claim 1 wherein the rearward ends of said pair of shafts are supported for rotation by a pair of spaced elongated support members which are disposed substantially in alignment with and extend rearwardly of said pair of shafts respectively, and a third plurality of elongated coplanar slide elements extending in spaced relation to one another between said pair of elongated support members at a position rearward of said first and second pluralities of slide elements relative to the die, each of said third plurality of slide elements extending completely across the space between said elongated support members and being attached at its opposing ends to said pair of elongated support members respectively.

11. The structure of claim 10 wherein each of said third plurality of slide elements constitutes a rotatable roller.

12. The structure of claim 1 wherein each of said first plurality of slide elements comprises an elongated freely rotatable roller, each of said second plurality of slide elements also comprising an elongated freely rotatable roller, each roller in said first plurality being disposed opposite to a corresponding roller in said second plurality with the free ends of each corresponding pair of rollers being spaced from one another along a center line between said pair of shafts, the rollers in said first plurality being respectively mounted for free rotation about axes of rotation which are substantially coincident with the axes of rotation of the rollers in said second plurality when said first and second pluralities are in said first relative position.

13. The structure of claim 1 including a plurality of spaced elongated guide strips mounted on said unit for positioning a blank on said slide elements.

14. The structure of claim 13 including means for selectively varying the positions of said guide strips relative to said shafts.

* * * * *